US005372923A

United States Patent [19]

Kurachi et al.

[11] Patent Number: 5,372,923

[45] Date of Patent: Dec. 13, 1994

[54] LIGHT-SENSITIVE SILVER HALIDE PHOTOGRAPHIC MATERIAL

[75] Inventors: Yasuo Kurachi; Yoichi Saito; Kiyokazu Morita; Hirokazu Koyama; Yoshihiro Wada, all of Hino, Japan

[73] Assignee: Konica Corporation, Japan

[21] Appl. No.: 53,992

[22] Filed: Apr. 26, 1993

[30] Foreign Application Priority Data

May 13, 1992 [JP] Japan ..... 4-120575
May 15, 1992 [JP] Japan ..... 4-123743
May 15, 1992 [JP] Japan ..... 4-123744

[51] Int. Cl.[5] ..... G03C 1/32

[52] U.S. Cl. ..... 430/527; 430/530; 430/631

[58] Field of Search ..... 430/527, 530, 631, 950, 430/961, 523

[56] References Cited

U.S. PATENT DOCUMENTS 4,394,441 7/1983 Kawaguchi et al. ..... 430/530
5,122,445 6/1992 Ishigaki ..... 430/530

*Primary Examiner*—Thorl Chea
*Attorney, Agent, or Firm*—Jordan B. Bierman

[57] ABSTRACT

A light-sensitive silver halide photographic material is disclosed which comprises a support and provided thereon, a light sensitive silver halide emulsion layer, and a conductive layer comprising a conductive material in an amount of 0.01 to 30% by volume and a binder, the conductive material being powder comprising an oxide of a metal selected from Zn, Ti, Al, In, Si, Mg, Ba, Mo, W and V, said powder having a specific volume resistance of not more than $10^7$ Ω·cm and having a particle structure with a linkage of 3 to 1000 primary particles of the oxide.

9 Claims, No Drawings

LIGHT-SENSITIVE SILVER HALIDE PHOTOGRAPHIC MATERIAL

FIELD OF THE INVENTION

The present invention relates to a light-sensitive silver halide photographic material (hereinafter abridged as light-sensitive photographic material) so improved that its antistatic properties can be less influenced by changes in humidity. More particularly it relates to a light-sensitive silver halide photographic material improved in its antistatic properties without having an ill influence on photographic performances and causing any pressure marks and abrasion marks.

BACKGROUND OF THE INVENTION

Because of commonly strong static charge build-up, plastic films have been hitherto often limited in their use other than the use taking advantage of such properties. For example, light-sensitive photographic materials commonly make use of plastic film as a support having electrical insulation properties. Such materials belong to what is called composite materials, comprised of the support and a light-sensitive photographic material layer. Hence the light-sensitive photographic materials tend to be statically charged when, during their manufacture and use, they come into contact with the surface of a material of the same or different kind or they are separated therefrom. Most static charges accumulated as a result of static charging cause various difficulties. The most important difficulty is what is called static marks, which are spots or branch-type or feather-type lines occurring during the photographic processing of films whose light-sensitive silver halide emulsion layers have been sensitized as a result of the discharge of static electricity accumulated before the photographic processing. When, for example, this phenomenon occurs in medical or industrial X-ray films, it leads to a very dangerous determination. This phenomenon for the fist time becomes known upon the photographic processing of films, and is one of very difficult problems. These accumulated static charges may also cause troubles such that dust adheres to the film surfaces and no uniform coating on the film surfaces can be carried out.

Such troubles caused by static charging may also occur in many cases besides the foregoing. For example, in the course of manufacture, the troubles may be caused by contact friction between photographic films and rollers and by separation of emulsion sides from support sides in the course of winding-up or unwinding of photographic films. In finished products, the troubles may be caused by separation of emulsion sides from base sides when photographic films are wound up and change-over is made, and by contact and separation occurring between X-ray films and machine parts during automatic photographing or between X-ray films and intensifying screens. The troubles may also be caused by contact with other packaging materials. The static marks of light-sensitive photographic materials, caused by accumulation of such static charges become remarkable with an increase in sensitivity of light-sensitive photographic materials and an increase in processing speed thereof. In particular, in these days, static marks more tend to occur since photographic materials have been made to have a higher sensitivity and are often handled under severe conditions such that light-sensitive coating is carried out at a higher speed, photographs are taken at a higher speed and automatic processing is carried out at a higher speed.

Moreover, in recent years, adhesion of dust after photographic processing has come into question, and it is sought to make an improvement so that antistatic properties can also be retained after the processing.

The best method for eliminating such difficulties due to static is to increase electrical conductivity of substances so that static charges can be dissipated in a short time before the discharge of accumulated electricity takes place.

Accordingly, methods of improving the conductivity of supports of light-sensitive photographic materials or that of surface layers of various coatings have been hitherto proposed and it has been attempted to utilize various hygroscopic substances and water-soluble inorganic salts and certain types of surface active agents and polymers. For example, Japanese Patent Publications Open to Public Inspection [hereinafter referred to as Japanese Patent O.P.I. Publication(s)] No. 91165/1974 and No. 121523/1974 disclose examples in which ion type polymers having a dissociative group in the polymer main chain are applied. Other invention is also known which relates to conductive polymers as disclosed in Japanese Patent O.P.I. Publications No. 9689/1990 and No. 182491/1990 and surface active agents as disclosed in Japanese Patent O.P.I. Publications No. 55541/1988, No. 148254/1988, No. 148256/1988 and No. 314191/1989.

These many substances have a specificity depending on the types of film supports and the differences in photographic compositions and can give good results on certain types of film supports, photographic emulsions and other photographic components. They, however, not only can be of no use at all for antistatic in the case of other different types of film supports and photographic components, but also may adversely affect photographic performance. Another important disadvantage thereof is that these many substances lose their function as a conductive layer when used in an environment of low humidity.

For the purpose of preventing the deterioration of performance in an environment of low humidity, Japanese Patent Examined Publications No. 6616/1960 and No. 20735/1989 disclose techniques in which metal oxides are used as antistatic treatments. The former discloses a method in which a colloidal sol dispersion is used. The latter discloses a method in which a highly crystalline metal oxide powder having been treated at a high temperature is used so that a problem concerning conductivity in the former can be eliminated. In the latter technique, however, it is stated that because of the use of a highly crystalline powder its particle diameter, the ratio of particles to a binder, etc. must be taken into account as countermeasures to the scatter of light. Japanese Patent O.P.I. Publication No. 29134/1992 also discloses a method in which a particulate metal oxide and a fibrous metal oxide are employed in conductive materials used in light-sensitive photographic materials for the purpose of not only improving performance in an environment of low humidity but also eliminating other disadvantages. There, however, have remained a problem concerning the amount of the oxides added.

Thus, in relation to light-sensitive photographic materials provided with a layer containing conductive fine metal particles, problems have remained unsettled yet even though means for preventing the deterioration of performance in an environment of low humidity have been studied for a period of as long as 30 years or more since the above techniques have been disclosed in Japanese Patent Examined Publication No. 6616/1960.

For example, in the case when a layer containing such conductive fine metal particles is provided adjoiningly to a silver halide layer containing silver halides, there is the problem that pressure marks or abrasion marks tend to occur in images as a result of any friction caused when light-sensitive photographic materials are handled. For another example, in the case when such particles are used as a mixture with a binder, there is the problem that fine particles present on the surface may fall as a result of any friction caused when light-sensitive photographic materials are manufactured or handled, and hence may adhere to rollers in the course of the manufacture to scratch the products being carried.

As a means for preventing the dust of metal oxide from falling and the silver halides from suffering pressure marks or abrasion marks, Japanese Patent O.P.I. Publication No. 104931/1982 discloses use of a metal oxide such as zinc oxide, stannic oxide or indium oxide in a backing layer. Since, however, metal oxides having conductivity are commonly colored, fogging due to coloring may occur when contained in light-sensitive materials, to cause a great problem. According to the method disclosed in Japanese Patent O.P.I. Publication No. 104931/1982, any of these metal oxides must be used in an amount of about 1 g as described in Examples, and its coloring (dark blue) appears as fog to greatly damage photographic performance (light transmission properties).

SUMMARY OF THE INVENTION

An object of the present invention is to provide a light-sensitive photographic material that may cause no dust fall of antistatic agents, may cause no pressure marks or abrasion marks, has an excellent transparency and has a high antistatic performance even in an environment of low humidity.

DETAILED DESCRIPTION OF THE INVENTION

The above object of the present invention has been achieved by a light-sensitive silver halide photographic material comprising a support and provided thereon, a light-sensitive silver halide emulsion layer and a conductive layer comprising a conductive material in an amount of 0.01 to 30% by volume, wherein the conductive material is powder comprising an oxide of a metal selected from Zn, Ti, Al, In, Si, Mg, Ba, Mo, W and V, said powder having a specific volume resistance of not more than $10^7$ Ω·cm and comprising a particle structure with a linkage of many primary particles of the oxide.

The particle diameter of the primary particle diameter is preferably 100 Å to 2 μm. The powder of the invention preferably has a particle structure with a major axis of 300 Å to 6 μm.

That is, as known in the art, the conductivity of these metal oxide powders is exhibited by charge carriers such as cations, anions or electrons or positive holes present in oxides. The total electrical conductivity thereof is expressed as follows:

$$\sigma t = \sigma c + \sigma a + \sigma n + \sigma p$$

wherein;

σc is electrical conductivity of cations;

σa is electrical conductivity of anions;

σn is electrical conductivity of electrons; and

σp is electrical conductivity of positive holes.

When the charge carriers are mainly ions, a solid electrolyte is formed. When the charge carriers are electrons, semiconductors are formed. In usual instances, conductors comprised of a mixture of the both are formed, and non-stoichiometric compounds such as oxygen-deficient oxides, metal-excess oxides, metal-deficient oxides and oxygen-excess oxides are formed as semiconductors. In other words, crystals having imperfections tend to be more preferable than perfect crystals in respect of the conductivity. As known in the art, the imperfections in crystals as exemplified by plane imperfections due to cleavage, line imperfections and vacancies due to dislocation and point imperfections due to interlattice atoms such as impurities causes imperfectness of crystals, so that crystal size becomes smaller than apparent particle size. More specifically, the ratio of particle size to crystallite size is 1 in the case of perfect crystals, and this ratio becomes larger as crystals are more imperfect. When this ratio is 2 or more, the conductivity becomes higher than that of perfect crystals. However, the presence of excess grain boundaries in particles because of too many imperfections may result in a decrease in conductivity. Hence, this ratio should preferably be not more than 2,000. Since most metal oxide powders commonly have a specific gravity of 2 or more, the particle size is restricted in its upper limit in view of the stability of film coating solutions. Thus the ratio of particle size to crystallite size is so selected as to preferably be not less than 2 to not more than 2,000, and more preferably not less than 10 to not more than 1,000. It may still more preferably be less than 500.

To measure the crystallite size pertaining to the present invention, calculation is made on the basis of the Scherrer's equation, which is widely used in powder X-ray diffraction. That is;

$$t = 0.9 \times \lambda / B \times \cos\theta_B$$

wherein;

B is a half-width of a diffraction curve based on the reflection on a certain plane of a crystal, measured by powder X-ray diffraction, which is measured in radian;

λ is a wavelength of X-rays; and $\theta_B$ is a Bragg angle.

[See X-SEN KAISETSU YOURON (Introduction to X-ray Diffraction), pages 91–96, K. K. Agunekariti]

With regard to the particle size, it is preferable to employ average particle diameter determined by measurement using a particle size distribution meter according to the laser diffraction method or the like. The particle size may also be determined from electron microscope photographs. In the case when an electron microscope is used, the longest diameter of particles independently present in the visual field is employed. In the case when particles chemically stand in a line to form a higher order structure, the particle size is measured in the unit of higher order structure.

Various empirical formulas have been proposed with regard to synthetic resistance of composites formed when such metal oxide conductors or semiconductors are dispersed in, e.g., an insulative polymer. Examples thereof can be shown as the following (1) to (5).

$$R_0 = \Sigma m_i R_i \quad (1)$$

Series junction ((4):$n = 1$)

$$1/R_0 = \Sigma m_i R_i \quad (2)$$

Parallel junction ((4):$n = -1$)

$$R_0^{\frac{1}{2}} = \Sigma m_i R_0^{\frac{1}{2}} \quad (3)$$

((4):$n = \frac{1}{2}$)

$$R_{0n} = \Sigma m_i R_{in} (-1 \leqq n \leqq 1) \quad (4)$$

$$\log_e R_0 = \Sigma m_i \log_e R_i \quad (5)$$

Here, concerning the mechanism of conduction between powders, the conduction is said to occur by virtue of a tunnel effect acting between very close particles. Hence, in the case when there is a distance between particles, currents flow with difficulty. On the other hand, in the case when particles are in contact with each other, the conductivity increases. In the case when the higher order structure of particles is constituted of a line of primary particles, the conductivity between particles continuously present can be expected to be a higher conductivity than that between particles dispersed without formation of the higher order structure. However, as is seen in semiconductors as exemplified by Be-doped SiC, the grain boundaries formed between particles may assume an insulating phase, so that in some instances the particles become an insulator. The present inventors made extensive studies on the relationship between elements constituting a semiconductor and conductivity, and on the relationship between the shape of semiconductor particles dispersed in an insulator or a volume fraction of powder comprised of the particles and conductivity. As a result, they have accomplished the present invention.

In the case of the present invention, the metal powder can be effective when added in a smaller amount than the metal powder conventionally used for photographic antistatic. With regard to the amount of the powder added, the object can be well achieved when it is added in a volume fraction of not more than 30%. The powder is preferably added in a volume fraction of not more than 10%. It may more preferably be in a volume fraction of not more than 5%, provided that it must be in a volume fraction of not less than 0 01% Its addition in a volume fraction smaller than that can not be well effective. Some compounds may require its addition in a volume fraction of not less than 1%.

According to this volume fraction, the amount of metal powder used comes to be approximately from 0.00005 to 1 g per square meter of light-sensitive photographic material, so that a higher antistatic can be achieved by its use in a smaller amount than in the conventional cases. Hence a good transparency can be achieved, and also the pressure marks, abrasion marks, etc. can be prevented from occurring when light-sensitive photographic materials are handled.

The metal oxide powder having conductivity of the present invention will be described below.

Metal oxides may preferably be exemplified by ZnO, $TiO_2$, $SnO_2$, $Al_2O_3$, $In_2O_3$, $SiO_2$, MgO, BaO, $MoO_2$, $WO_3$ and $V_2O_5$ or a complex oxide of any of these, and particularly preferably ZnO, $TiO_2$ and $SnO_2$. As examples in which different kind of atoms are contained, addition of Al or In to ZnO, addition of Nb or Ta to $TiO_2$ and addition of Sb, Nb or a halogen atom to $SnO_2$ are effective. Such different kind of atoms may preferably be added in an amount ranging from 0.01 mol % to 25 mol %, and particularly preferably from 0.1 mol % to 15 mol %.

Any of these metal oxide powders having conductivity have a specific volume resistance of $10^{-2}$ to $10^7$ Ω·cm , and more preferably $10^0$ to $10^5$ Ω·cm .

A method of measuring specific volume resistance of powder will be described below.

A value of specific volume resistance in a large single crystal of oxides means that of specific volume resistance of the single crystal. In powder which a large single crystal cannot be obtained, it means specific volume resistance of a sintered product obtained through molding the powder. When the value of powder is unknown, a value obtained by dividing by $10^2$ specific volume resistance of a product molded by applying a specific pressure to the powder is used as specific volume resistance of the powder. The specific pressure is preferably 10 kg/cm$^2$ or more, and more preferably 100 kg/cm$^2$ or more. The specific volume resistance of powder in the invention means a value obtained by dividing by $10^2$ specific volume resistance of a product molded by applying a pressure of 100 kg/cm$^2$ to the powder. The specific volume resistance was measured employing H-restor AP produced by Mitsubishi Yuka Co., Ltd.

With regard to the diameter of particles having a higher order structure, it is preferable to employ average particle diameter determined by making measurement using a particle size distribution meter according to the sedimentation method, the laser diffraction method or the like. With regard to a primary particle diameter, the particle diameter must be determined from an electron microscope photograph. In the case when only an electron microscope is used to make measurement of the both, the longest diameter of particles independently present in the visual field is employed as the diameter of particles having a higher order structure, and the diameter of particles among which grain boundaries are clearly present is employed as the primary particle diameter.

The higher order structure of particles will be detailed here. A linkage of particles may be branched, may be orderly arranged in a linear fashion, or may be spiral. It is more preferable for them to be arranged in a linear fashion. The number of particles in the linkage may be not less than 3 to not more than 1,000, preferably less than 500, and more preferably not less than 3 to less than 100, as ranges preferably selected in view of dispersibility. However, any powder usually synthesized has a variety to not only particle size distribution but also particle shape, and hence in some instances it is economically disadvantageous to separate only the particles with the linkage. Particles other than the particles with the linkage herein referred to, i.e., particles with a linkage of not more than 2 may be contained without any exclusion thereof so long as the object of the present invention can be achieved. However, inclusion of such particles by 40% by volume or more in the particles is not preferable since it becomes impossible to achieve what is intended in the present invention, unless the powder is added in a volume fraction of more than 20%.

The metal oxide powder can be synthesized by any of known powder synthesis methods so long as the object of the present invention can be achieved. For example, a fine particle and ultrafine particle preparation process may be used, such as the coprecipitation process, multistage process, sol-gel process, atomizing process or plasma thermal decomposition process that uses as a starting material a transition metal or a compound containing a transition metal. Herein the transition metal or the compound containing a transition metal refers to a compound mainly composed of Zn, Ti, Sn, Al, In, Si, Mg, Ba, Mo, W or V, and preferably a water-soluble or organic solvent-soluble compound, as exemplified by water-soluble metal salts such as $FeSO_4H_2O$ and $CuSO_4$, organic solvent-soluble transition metal compounds such as $NiCl_2$ and $PdCl_2$, metal alkoxides such as $Ti(OC_3H_7)$, and organic metal compounds such as ferrocene. Depending on the powder synthesis methods, it is also possible to use materials that are solid at room temperature, mainly composed of Zn, Ti, Sn, Al, In, Si, Mg, Ba, Mo, W or V. Thus, there are no particular limitations. The powder of the invention is preferably a powder synthesized through heat treatment carried out at 400° C. or below.

The conductive layer of the present invention may contain a conductive polymeric compound. Such a compound may preferably be exemplified by polyvinylbenzene sulfonates, polyvinylbenzyl trimethylammonium chloride, quaternary salt polymers and polymer latexes.

The conductive metal oxide powder and the conductive polymeric compound are used by their dispersion or dissolution in a binder.

There are no particular limitations on the binder used in the present invention so long as it is capable of forming a film. For example, the binder may include proteins such as gelatin and casein, cellulose compounds such as carboxymethyl cellulose, hydroxyethyl cellulose, acetyl cellulose, diacetyl cellulose and triacetyl cellulose, saccharides such as dextran, agar-agar, sodium alginate and starch derivatives, and synthetic polymers such as polyvinyl alcohol, polyvinyl acetate, polyacrylates, polymethacrylates, polystyrene, polyacrylamide, poly-N-vinyl pyrrolidone, polyester, polyvinyl chloride and polyacrylic acid.

In particular, it is preferred to use gelatin such as lime-treated gelatin, acid-treated gelatin, enzymolyzed gelatin, phthalated gelatin or acetylated gelatin, acetyl cellulose, diacetyl cellulose, triacetyl cellulose, polyvinyl acetate, polyvinyl alcohol, polybutyl acrylate, polyacrylamide, or dextran.

In the present invention, as a component layer of the light-sensitive photographic material, at least one layer is provided for the conductive layer containing the conductive metal oxide. For example, the layer may be any of a surface-protective layer, a backing layer, an intermediate layer and a subbing layer. If necessary, two or more layers may optionally be provided for that layer.

The support that can be used in the present invention may include, for example, cellulose nitrate film, cellulose acetate film, cellulose acetate butyrate film, cellulose acetate propionate film, polystyrene film, polyethylene terephthalate film and polycarbonate film, as well as laminates of any of these. More specifically, it may include paper coated or laminated with baryta or an $\alpha$-olefin polymer, in particular, an $\alpha$-olefin polymer having 2 to 10 carbon atoms such as polyethylene, polypropylene or an ethylene-butene copolymer.

These supports may be appropriately selected from transparent supports and opaque supports according to the purpose for which light-sensitive photographic materials are used. The transparent supports are not limited to only colorless transparent ones, and may be colored transparent ones to which a dye or a pigment has been added.

A polyol compound such as ethylene glycol, propylene glycol or 1,1,1-trimethylol propane may also be added to the protective layer or other layer of the present invention. Its addition can bring about a more preferable antistatic effect.

The light-sensitive material according to the present invention may include various light-sensitive materials including usual black and white light-sensitive silver halide photographic materials as exemplified by black and white light-sensitive materials for photographing, X-ray black and white light-sensitive materials and black and white light-sensitive materials for printing, and usual multi-layer color light-sensitive materials as exemplified by color reversal films, color negative films and color positive films. In particular, the present invention is greatly effective for high-temperature processing light-sensitive silver halide photographic materials and high-speed light-sensitive silver halide photographic materials.

The light-sensitive silver halide photographic material according to the present invention will be briefly described below.

The binder used in the photographic layers may include proteins such as gelatin and casein, cellulose compounds such as carboxymethyl cellulose, hydroxyethyl cellulose and dextran, sugar derivatives such as agar-agar, sodium alginate and starch derivatives, and synthetic hydrophilic colloids as exemplified by polyvinyl alcohol, poly-N-vinyl pyrrolidone, polyacrylic acid copolymers, polyacrylamide, or derivatives or partially hydrolyzed products of these, which can be used in combination.

The gelatin herein noted refers to what is called lime-treated gelatin, acid-treated gelatin or enzymolyzed gelatin.

To the photographic component layers of the present invention, other known surface active agents may also be added alone or in the form of a mixture. They are used as coating aids, and in some instances also used for other purposes, e.g., for emulsification dispersion, sensitization and improvement of other photographic performances.

The light-sensitive photographic material of the present invention may contain in its photographic component layers the polymer latex disclosed in U.S. Pat. No. 3,411,911.

Silver halide grains in emulsions may be those having a regular crystal form such as a cube or an octahedron, or may be those having irregular crystal form such as a sphere, a plate or a potato or those having a composite form of any of these crystal forms. They may also be comprised of a mixture of grains having various crystal forms. Tabular grains having a grain diameter five times or larger than grain thickness can be preferably used in the present invention.

In the present invention, light-sensitive silver halide emulsions may be used in the form of a mixture of two or more silver halide emulsions. The emulsions mixed may be different in their particle size, halogen composition, sensitivity and so forth. A substantially non-sensitive emulsion may be mixed in a light-sensitive emulsion, or may be separately used in a separate layer. For example, a light-sensitive emulsion comprising spherical or potatolike grains and a light-sensitive silver halide emulsion comprising tabular grains having a grain diameter five times or larger than grain thickness may be used in the same layer or in different layers. When used in different layers, the light-sensitive silver halide emulsion comprising tabular grains may be present at the side near to the support or on the other hand may be present at the side distant therefrom.

EXAMPLES

The present invention will be described below in detail by giving Examples. Embodiments of the present invention are by no means limited to these.

Synthesis of Powder P1

To 1,800 g of saturated ammonium hydrogen-carbonate solution, 500 g of an aqueous 17 wt. % stannic chloride solution is slowly added with stirring using a laboratory mixer, to produce a gel-dispersed solution. The gel thus formed is taken out by decantation, and the gel is washed with distilled water many times. In the distilled water with which the gel has been washed, silver nitrate is dropwise added to confirm that no precipitation is formed. Thereafter, ammonia water is added in 1,000 cc of distilled water to give an aqueous solution adjusted to have a pH of about 9, followed by dispersion of the gel in the solution with vigorous stirring using a laboratory mixer. To the resulting dispersion, 2 g of antimony oxide gel synthesized in a similar manner as above is added to prepare a gel Slurry. This is enclosed in an autoclave, followed by hydrothermal reaction at 200° C. for 8 hours. Thus, powder is obtained. The specific volume resistance of this powder was 10 Ω·cm . This powder is designated as powder P1.

Synthesis of Powder P2

Powder P1 is subjected to pulverization for 24 hours in a ball mill made of alumina to obtain powder P2. The specific volume resistance was $10^3$ Ω·cm.

Synthesis Powder P3

To 1,800 g of saturated ammonium hydrogencarbonate, 500 g of aqueous 17 wt. % stannic chloride solution is slowly added with stirring using a laboratory mixer, to produce a gel-dispersed solution. The gel thus formed is taken out by decantation, and the gel is washed with distilled water many times. In the distilled water with which the gel has been washed, silver nitrate is dropwise added to confirm that no precipitation is formed. Thereafter, ammonia water is added in 1,000 cc of the distilled water to give an aqueous solution adjusted to have a pH of about 9, followed by dispersion of the gel with vigorous solution using a laboratory mixer. The resulting dispersion is enclosed in an autoclave, followed by hydrothermal reaction at 200° C. for 8 hours. The resulting powder was put to measurement by powder X-ray analysis to determine the crystallite size, which was found to be about 300 Å. The particle diameter was also determined using an electron microscope, and the ratio of particle size to crystallite size was calculated to find that it was 3.5. The specific volume resistance of this powder was $10^5$ Ω·cm . This powder is designated as powder P3.

Synthesis Powder P4

The resulting slurry prepared in synthesis of Powder P1 is sprayed in a cylinder type electric furnace maintained at 350° C. and whose wall surface is made of quartz, and the powder is collected in a dry state. The specific volume resistance of this powder was $10^3$ Ω·cm. The powder obtained is designated as powder P4.

EXAMPLE 1

Preparation of Support

To both sides of a polyethylene terephthalate film having a thickness of 100 μm after biaxial stretching and thermal fixing, corona discharging was applied at 8 W min/m$^2$. The film thus treated was coated on one side thereof with the following subbing coating solution B-1 as described in Japanese Patent O.P.I. Publication No. 19941/1984, so as to have a dried coating thickness of 0.8 μm, followed by drying at 100° C. for 1 minute to form a subbing layer B-1. The polyethylene terephthalate film was further coated on its side opposite to the subbing layer B-1 side with the following subbing coating solution B-2 as described in Japanese Patent O.P.I. Publication No. 77439/1984, so as to have a dried coating thickness of 0.8 μm, followed by drying at 100° C. for 1 minute to form a subbing layer B-2.

| | |
|---|---|
| First subbing layers | |
| Subbing coating solution B-1 | |
| Copolymer latex solution comprised of 30% by weight of butyl acrylate, 20% by weight of t-butyl acrylate, 25% by weight of styrene and 25% by weight of 2-hydroxyethyl acrylate (solid content: 30%) | 270 g |
| Compound A | 0.6 g |
| Hexamethylene-1,6-bis(ethyleneurea) | 0.8 g |
| Made up to 1 liter by adding water. | |
| Subbing coating solution B-2 | |
| Copolymer latex solution comprised of 40% by weight of butyl acrylate, 20% by weight of styrene and 40% by weight of glycidyl acrylate (solid content: 30%) | 270 g |
| Compound A | 0.6 g |
| Hexamethylene-1,6-bis(ethyleneurea) | 0.8 g |
| Made up to 1 liter by adding water. | |
| Second subbing layers | |
| To the above subbing layers B-1 and B-2, corona discharging was applied at 8 W min/m$^2$, and the following coating solution B-3 was coated thereon so as to give a dried coating thickness of 0.1 μm each, followed by drying at 100° C. for 1 minute. | |
| Subbing coating solution B-3 | |
| Gelatin | 10 g |
| Compound A | 0.4 g |
| Compound B | 0.1 g |
| Silica particles with an average particle diameter of 3 μm | 0.1 g |
| Powder P1 | 10 g |
| Made up to 1 liter by adding water. | |

Compound A

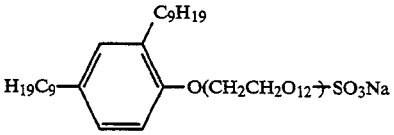

Compound B

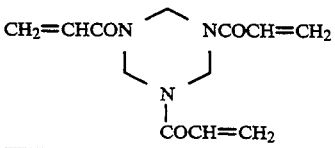

Preparation of Emulsion

In an acidic atmosphere of pH 3.0, grains containing rhodium in an amount of $10^{-5}$ mol per mol of silver was produced by controlled double-jet precipitation. The grains were grown in a system containing benzyladenine in an amount of 30 mg per liter of an aqueous 1% gelatin solution. After silver and halide were mixed, 6-methyl-4-hydroxy-1,3,3a,7-tetrazaindene was added in an amount of 600 mg per mol of silver halide, followed by washing to carry out desairing.

Subsequently, 6-methyl-4-hydroxy-1,3,3a,7-tetrazaindene was added in an amount of 60 mg per mol of silver halide, and thereafter sulfur sensitization was carried out. After the sulfur sensitization was completed, 6-methyl-4-hydroxy-1,3,3a,7-tetrazaindene was added as a stabilizer.

Silver Halide Emulsion Layer

To the above emulsion, additives were added so as to give the following coating weights, and the emulsion thus prepared was coated on the support described above.

| | |
|---|---|
| Latex polymer: Styrene/butyl acrylate/acrylic acid terpolymer | 1.0 g/m$^2$ |
| Tetraphenylphosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 200 mg/m$^2$ |
| Phenidone | 100 mg/m$^2$ |
| Styrene sodium sulfonate/maleic acid copolymer (Mw: 250,000) | 200 mg/m$^2$ |
| Butyl gallate | 500 mg/m$^2$ |
| Hydrazine compound | 20 mg/m$^2$ |
| 5-Methylbenzotriazole | 30 mg/m$^2$ |
| 2-Mercaptobenzimidazole-5-sulfonic acid | 30 mg/m$^2$ |
| Inert ossein gelatin (isoelectric point: 4.9) | 1.5 g/m$^2$ |
| 1-(p-Acetylamidophenyl)-5-mercaptotetrazole | 30 mg/m$^2$ |
| Silver weight | 2.8 g/m$^2$ |
| Emulsion layer protective layer: | |
| To form an emulsion layer protective layer, a coating solution was prepared so as to give the following coating weights, and coated. | |
| Fluorinated dioctylsulfosuccinate | 300 mg/m$^2$ |
| Matting agent: | 100 mg/m$^2$ |
| Polymethyl methacrylate (average particle diameter: 3.5 μm) | |
| Lithium nitrate | 30 mg/m$^2$ |
| Acid-treated gelatin (isoelectric point: 7.0) | 1.2 g/m$^2$ |
| Colloidal silica | 50 mg/m$^2$ |
| Styrene sodium sulfonate/maleic acid copolymer | 100 mg/m$^2$ |
| Mordant | 30 mg/m$^2$ |
| Dye | 30 mg/m$^2$ |

Mordant

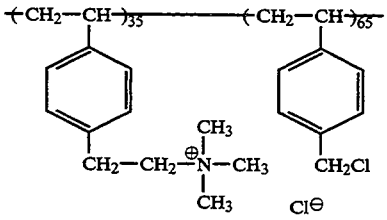

Dye

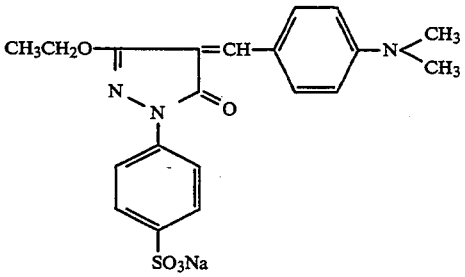

Backing Layer

The support was coated on its side opposite to the emulsion layer side with the following backing dye solution. The gelatin layer was hardened using glyoxal, 1-oxy-3,5-dichloro-S-triazine sodium salt and a hydroxy-containing epoxy compound (d).

| | |
|---|---|
| Hydroquinone | 100 mg/m$^2$ |
| Phenidone | 30 mg/m$^2$ |
| Latex polymer: Butyl acrylate/styrene copolymer | 0.5 g/m$^2$ |
| Styrene/maleic acid copolymer | 100 mg/m$^2$ |
| Citric acid | 40 mg/m$^2$ |
| Benzotriazole | 100 mg/m$^2$ |
| Styrene sulfonic acid/maleic acid copolymer | 100 mg/m$^2$ |
| Lithium nitrate | 30 mg/m$^2$ |
| Backing dye (a) | 40 mg/m$^2$ |
| Backing dye (b) | 30 mg/m$^2$ |
| Backing dye (c) | 30 mg/m$^2$ |
| Ossein gelatin | 2.0 g/m$^2$ |

Backing dye (a)

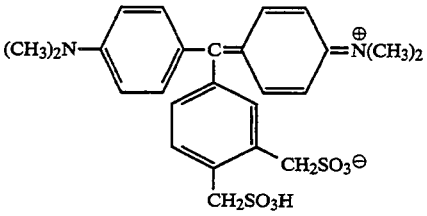

Backing dye (b)

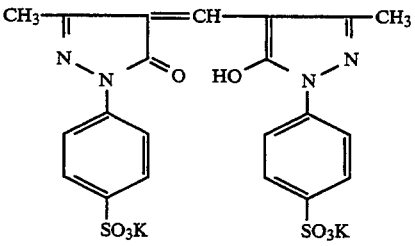

Backing dye (c)

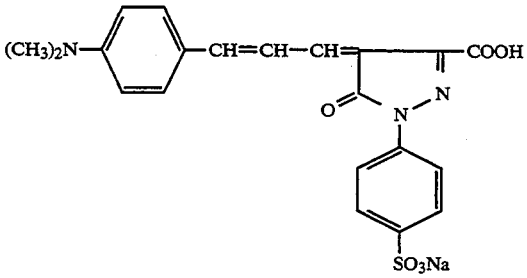

Epoxy compound (d)

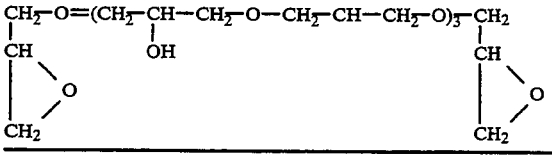

The sample obtained in the manner as described above was subjected to exposure, and photographically processed using the following developing solution and fixing solution. Thereafter, a haze test, a surface specific resistance test and an ash adhesion test were made.

| Formulation of developing solution | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-soulfosalicylate | 75 g |
| Sodium ethylenediaminetetraacetate | 2 g |
| Made up to 1 liter by adding water. | |
| The pH was adjusted to 11.5 using sodium hydroxide. | |
| Formulation of fixing solution | |
| (Composition A) | |
| Ammonium thiosulfate (aqueous 72.5 wt. % solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (aqueous 90 wt. % solution) | 13.6 ml |
| (Composition B) | |
| Pure water (ion-exchanged water) | 17 ml |
| Sulfuric acid (aqueous 50 wt. % solution) | 3.0 g |
| Aluminum sulfate (aqueous 8.1 wt. % solution in terms of $Al_2O_3$) | 20 g |

When the fixing solution was used, the above compositions A and B were dissolved in this order in 400 ml of water and put to use. This fixing solution had a pH of about 5.6.

| Processing conditions: | | |
|---|---|---|
| Step | Temperature | Time |
| Developing | 40° C. | 8 seconds |
| Fixing | 35° C. | 8 seconds |
| Washing | Room temp. | 10 seconds |

Evaluation of antistatic performance: Ash adhesion test

In an environment of 23° C. and 20%RH, the emulsion side surface of the sample having been processed was rubbed several times with a rubber roller, and ashes of a cigarette ware brought close to the surface to examine whether or not the ashes adhered to the surface.

Evaluation was made according to the following:

A: No ashes adhere at all even when brought close up to a distance of 1 cm from the surface.

AB: Ashes adhere when brought close up to a distance of 1 cm to 4 cm from the surface.

C: Ashes adhere when brought close up to a distance of 4 cm to 10 cm from the surface.

D: Ashes adhere even when kept at a distance of 10 cm or more.

There is no problem in practical use when evaluated as "AB" or above.

Measurement of surface specific resistance:

Measured at an applied voltage of 100 V and in an environment of 23° C., 20%RH, using a teraohmmeter VE-30, manufactured by Kawaguchi Denki K. K.

Haze test:

Haze of a sample provided with a multi-layer light-sensitive photographic layer by coating and thereafter photographically processed without exposure to light was measured using a turbidimeter Model T-2600DA, manufactured by Tokyo Denshoku K. K., and was indicated in %.

EXAMPLE 2

A sample was prepared under the same conditions as in Example 1 except that the subbing coating solution B-3 was replaced with a subbing coating solution B-4 to form the subbing second layers. Evaluation was made in the same manner as in Example 1.

| Subbing coating solution B-4 | |
|---|---|
| Gelatin | 10 g |
| Compound A | 0.4 g |
| Compound B | 0.1 g |
| Silica particles with an average particle diameter of 3 μm | 0.1 g |
| Powder P1 | 5 g |
| Made up to 1 liter by adding water. | |

EXAMPLE 3

A sample was prepared under the same conditions as in Example 1 except that the subbing coating solution B-3 was replaced with a subbing coating solution B-5 to form the subbing second layers. Evaluation was made in the same manner as in Example 1.

| Subbing coating solution B-5 | |
|---|---|
| Gelatin | 10 g |
| Compound A | 0.4 g |
| Compound B | 0.1 g |
| Silica particles with an average particle diameter of 3 μm | 0.1 g |
| Powder P1 | 3 g |
| Made up to 1 liter by adding water. | |

EXAMPLE 4

A sample was prepared under the same conditions as in Example 1 except that the subbing coating solution B-3 was replaced with a subbing coating solution B-6 to form the subbing second layers. Evaluation was made in the same manner as in Example 1.

| Subbing coating solution B-6 | |
|---|---|
| Gelatin | 10 g |
| Compound A | 0.4 g |
| Compound B | 0.1 g |
| Silica particles with an average particle diameter of 3 μm | 0.1 g |
| Powder P1 | 1.5 g |
| Made up to 1 liter by adding water. | |

EXAMPLE 5

A sample was prepared under the same conditions as in Example 1 except that the subbing coating solution B-3 was replaced with a subbing coating solution B-7 to form the subbing second layers. Evaluation was made in the same manner as in Example 1.

| Subbing coating solution B-7 | |
|---|---|
| Gelatin | 10 g |
| Compound A | 0.4 g |
| Compound B | 0.1 g |
| Silica particles with an average particle diameter of 3 μm | 0.1 g |
| Powder P1 | 0.5 g |
| Made up to 1 liter by adding water. | |

EXAMPLE 6

A sample was prepared under the same conditions as in Example 1 except that the subbing coating solution B-3 was replaced with a subbing coating solution B-8 to form the subbing second layers. Evaluation was made in the same manner as in Example 1.

| Subbing coating solution B-8 | |
|---|---|
| Gelatin | 10 g |
| Compound A | 0.4 g |
| Compound B | 0.1 g |
| Silica particles with an average particle diameter of 3 μm | 0.1 g |
| Powder P2 | 3 g |
| Made up to 1 liter by adding water. | |

EXAMPLE 7

A sample was prepared under the same conditions as in Example 1 except that the subbing coating solution B-3 was replaced with a subbing coating solution B-9 to form the subbing second layers. Evaluation was made in the same manner as in Example 1.

| Subbing coating solution B-9 | |
|---|---|
| Gelatin | 10 g |
| Compound A | 0.4 g |
| Compound B | 0.1 g |
| Silica particles with an average particle diameter of 3 μm | 0.1 g |
| Powder P3 | 15 g |
| Made up to 1 liter by adding water. | |

EXAMPLE 8

A sample was prepared under the same conditions as in Example 1 except that the subbing coating solution B-3 was replaced with a subbing coating solution B-10 to form the subbing second layers. Evaluation was made in the same manner as in Example 1.

| Subbing coating solution B-10 | |
|---|---|
| Gelatin | 10 g |
| Compound A | 0.4 g |
| Compound B | 0.1 g |
| Silica particles with an average particle diameter of 3 μm | 0.1 g |
| Powder P4 | 15 g |
| Made up to 1 liter by adding water. | |

EXAMPLE 9

A sample was prepared under the same conditions as in Example 1 except that the subbing coating solution B-3 was replaced with a subbing coating solution B-11 to form the subbing second layers. Evaluation was made in the same manner as in Example 1.

| Subbing coating solution B-11 | |
|---|---|
| Gelatin | 10 g |
| Compound A | 0.4 g |
| Compound B | 0.1 g |
| Silica particles with an average particle diameter of 3 μm | 0.1 g |
| Powder P4 | 5 g |
| Made up to 1 liter by adding water. | |

COMPARATIVE EXAMPLE 1

A sample was prepared under the same conditions as in Example 1 except that the subbing coating solution B-3 was replaced with a subbing coating solution B-0 to form the subbing second layers. Evaluation was made in the same manner as in Example 1.

| Subbing coating solution B-0 | |
|---|---|
| Gelatin | 10 g |
| Compound A | 0.4 g |
| Compound B | 0.1 g |
| Silica particles with an average particle diameter of 3 μm | 0.1 g |
| Made up to 1 liter by adding water. | |

Results of evaluation are shown below.

TABLE 1

| | Powders used | Volume fraction (%) | Number *1 of particles in a linkage | Surface *2 specific resistance | Dust adhesion test | Haze test |
|---|---|---|---|---|---|---|
| Example: | | | | | | |
| 1 | P-1 | 16 | 18 | $2.5 \times 10^7$ | A | Good |
| 2 | P-1 | 8 | 18 | $1.8 \times 10^6$ | A | Good |
| 3 | P-1 | 5 | 18 | $1.2 \times 10^8$ | A | Good |
| 4 | P-1 | 2.5 | 18 | $6.5 \times 10^9$ | A | Good |
| 5 | P-1 | 0.8 | 18 | $9.9 \times 10^9$ | A | Good |
| 6 | P-2 | 5 | 5 | $6.5 \times 10^9$ | A | Good |
| 7 | P-3 | 26 | 16 | $2.5 \times 10^7$ | A | Good |
| 8 | P-4 | 26 | 18 | $2.5 \times 10^7$ | A | Good |
| 9 | P-4 | 8 | 18 | $1.8 \times 10^9$ | A | Good |
| Comparative Example: | | | | | | |
| 1 | — | 0 | — | $9.5 \times 10^{13}$ | D | Good |

*1: Average number of particles in a linkage, observed on an electron microscope.
*2: Surface specific resistance (Ω/square)

As is clear from Table 1, the examples of the present invention show results superior to the comparative example.

What is claimed is:

1. A light-sensitive silver halide photographic material comprising a support and provided thereon, a light sensitive silver halide emulsion layer and a conductive layer comprising a conductive material in an amount of 0.01 to 30 % by volume and a binder, wherein the conductive material is powder comprising an oxide of a metal selected from Zn, Ti, Al, In, Si, Mg, Ba, Mo, W and V, said powder having a specific volume resistance of not more than $10^7$ Ω·cm and having a particle structure with a linkage of 3 to 1000 primary particles of the oxide.

2. The material of claim 1, wherein the conductive layer comprises the powder in an amount of 0.01 to 10 % by volume of all conductive layer components.

3. The material of claim 1, wherein the metal oxide is selected from the group consisting of ZnO, $TiO_2$ and $SnO_2$.

4. The material of claim 1, wherein the conductive layer further comprises a conductive polymeric compound.

5. The material of claim 1, wherein the specific volume resistance is not more than $10^5$ Ω·cm.

6. The material of claim 1, wherein said powder has a particle structure with a linkage of 3 to less than 500 primary particles of the oxide.

7. The material of claim 1, wherein a ratio of particle size to crystallite size in said powder is 2 to 2000.

8. The material of claim 1, wherein a ratio of particle size to crystallite size in said powder is 10 to 1000.

9. The material of claim 1, wherein the powder is prepared by a method comprising applying heat of 400° C. or less to said powder.

* * * * *